US007789292B2

(12) United States Patent
West

(10) Patent No.: US 7,789,292 B2
(45) Date of Patent: Sep. 7, 2010

(54) BOX FLAP LOCKING SYSTEM WITH SIFT-PROOF BOTTOM

(75) Inventor: Thomas West, Greenfield Center, NY (US)

(73) Assignee: Norampac Schenectady, Inc., Schenectady, NY (US)

( * ) Notice: Subject to any disclaimer, the term of this patent is extended or adjusted under 35 U.S.C. 154(b) by 960 days.

(21) Appl. No.: 11/562,056

(22) Filed: Nov. 21, 2006

(65) Prior Publication Data

US 2008/0116249 A1 May 22, 2008

(51) Int. Cl.
*B65D 5/08* (2006.01)

(52) U.S. Cl. ..... 229/109; 229/133; 229/138; 229/143; 229/144

(58) Field of Classification Search ..... 229/109, 229/133, 138, 143, 144, 163; 206/45.29
See application file for complete search history.

(56) References Cited

U.S. PATENT DOCUMENTS

| | | | | |
|---|---|---|---|---|
| 902,213 | A | 10/1908 | Davidson | |
| 1,028,195 | A | 6/1912 | Davidson | |
| 1,092,210 | A | 4/1914 | Greve | |
| 1,230,675 | A * | 6/1917 | Cole | 229/143 |
| 1,769,183 | A | 7/1930 | Laubenheimer | |
| 1,779,403 | A | 10/1930 | Greve | |
| 2,373,423 | A | 4/1945 | Shina | |
| 2,666,567 | A | 1/1954 | Farrell | |
| 3,037,681 | A | 6/1962 | Kuchenbecker et al. | |
| 3,182,888 | A | 5/1965 | Chidsey, Jr. et al. | |
| 3,319,869 | A | 5/1967 | Ostwald | |
| 3,374,937 | A | 3/1968 | Wilson | |
| 3,432,085 | A | 3/1969 | Lock | |
| 3,512,697 | A * | 5/1970 | Robinson | 229/109 |
| 3,642,192 | A | 2/1972 | Wilcox, Jr. et al. | |
| 3,669,341 | A | 6/1972 | Hughes | |
| 3,770,187 | A | 11/1973 | Faires et al. | |
| 3,792,810 | A | 2/1974 | Tingley et al. | |
| 3,829,005 | A | 8/1974 | Hackenberg et al. | |
| 3,923,234 | A * | 12/1975 | Lund, Jr. | 229/109 |
| 4,013,213 | A | 3/1977 | Giebel | |
| 4,027,818 | A | 6/1977 | Stoll | |
| 4,201,331 | A * | 5/1980 | Austin | 229/143 |
| 4,313,556 | A * | 2/1982 | Boyle et al. | 229/110 |
| 4,502,624 | A * | 3/1985 | Burrell | 229/109 |
| 4,511,080 | A * | 4/1985 | Madsen et al. | 229/138 |
| 4,600,142 | A | 7/1986 | Quaintance | |
| 4,793,546 | A | 12/1988 | Nunn | |

(Continued)

OTHER PUBLICATIONS

West, U.S. Appl. No. 11/848,542, NORA-0001-CON, Office Action Communication, May 28, 2009, 7 pages.

*Primary Examiner*—Gary E Elkins
(74) *Attorney, Agent, or Firm*—Michael Hoffman; Hoffman Warnick LLC

(57) ABSTRACT

An octagonal shaped foldable box having a flap locking system. The foldable box includes: eight sidewall sections; a pair of opposing locking flaps extending from two of the eight sidewall sections, each opposing locking flap having a generally trapezoidal shaped tab cut therein for locking a first opposed locking flap with a second opposed locking flap; and a pair of opposing interior flaps, wherein each opposing interior flap extends from three of the eight sidewall sections, and wherein each opposing interior flap includes a first and a second flap edge, and each flap edge includes a fold-over region for forming a sealed corner with two sidewall sections.

19 Claims, 6 Drawing Sheets

U.S. PATENT DOCUMENTS

| | | | | |
|---|---|---|---|---|
| 4,899,927 | A | 2/1990 | Straub et al. | |
| 5,042,684 | A * | 8/1991 | West et al. | 229/133 |
| 5,348,148 | A * | 9/1994 | Lancaster | 229/109 |
| 5,390,790 | A | 2/1995 | Straub et al. | |
| 5,573,175 | A | 11/1996 | Straub et al. | |
| 6,012,629 | A | 1/2000 | Newcomer | |
| 6,206,279 | B1 | 3/2001 | Countee | |
| 6,364,200 | B1 | 4/2002 | Moss et al. | |
| 6,386,437 | B1 | 5/2002 | Larson, Jr. | |
| 6,431,435 | B1 | 8/2002 | Jones et al. | |
| 6,446,859 | B1 | 9/2002 | Holladay | |
| 6,688,514 | B2 | 2/2004 | Evans et al. | |
| 6,834,792 | B1 | 12/2004 | Perkins | |
| 7,159,761 | B2 | 1/2007 | Abshire et al. | |
| 7,278,565 | B2 | 10/2007 | West | |
| 2003/0192945 | A1 | 10/2003 | Quaintance | |
| 2004/0182916 | A1 | 9/2004 | Roseth | |
| 2007/0051783 | A1 * | 3/2007 | Wisecarver | 229/109 |

* cited by examiner

BOX FLAP LOCKING SYSTEM WITH SIFT-PROOF BOTTOM

CLAIM OF PRIORITY

The present invention claims priority to co-pending U.S. patent application Ser. No. 10/800,588, filed on Mar. 15, 2004, entitled "BOX FLAP LOCKING SYSTEM," which claims priority to U.S. Provisional Application Ser. No. 60/487,353, filed on Jul. 15, 2003, entitled "BOX FLAP LOCKING SYSTEM."

BACKGROUND OF THE INVENTION

1. Technical Field

The present invention relates generally to foldable containers, and more specifically relates to a box having flap locking system and sift-proof bottom.

2. Related Art

The ability to securely lock flaps of a foldable cardboard box (or similar type container) remains an ongoing problem. The problem is particularly challenging for a bottom side of the box where significant weight and stress can occur. For instance, in an 8-sided box, current designs utilize flaps that can easily become disengaged when stresses are place onto a loaded box. Accordingly, tape or other means, such as lock tabs, are required to hold the bottom flaps securely together. However, current lock tab designs protrude up and through the bottom inside of the box and can, for instance, catch on and tear a poly liner often used within boxes. Accordingly, a need exists for a foldable box design that includes flaps that can be securely locked without interfering with the interior space of the box.

In addition, it is often desirable to fill such boxes with a product that could potentially leak through the bottom corners of the box. Accordingly, a need exists for a foldable box design that provides sealed corners to eliminate leaking.

SUMMARY OF THE INVENTION

The present invention addresses the above-mentioned problems, as well as others, by providing a foldable box design having a box flap locking system and sealed bottom corners. In a first aspect, the invention provides an octagonal shaped foldable box having a flap locking system, comprising: eight sidewall sections; a pair of opposing locking flaps extending from two of the eight sidewall sections, each opposing locking flap having a generally trapezoidal shaped tab cut therein for locking a first opposed locking flap with a second opposed locking flap; and a pair of opposing interior flaps, wherein each opposing interior flap extends from three of the eight sidewall sections, and wherein each opposing interior flap includes a first and a second flap edge, and each flap edge includes a fold-over region for forming a sealed corner with two sidewall sections.

In a second aspect, the invention provides a foldable box having sealed corners, comprising: eight sidewall sections; a pair of opposing exterior locking flaps extending from a first pair of the eight sidewall sections, each opposing locking flap having a locking mechanism cut therein for locking a first opposed locking flap with a second opposed locking flap; and a pair of opposing interior flaps, wherein each opposing interior flap extends from three of the eight sidewall sections, and wherein each opposing interior flap includes a first and a second flap edge, and each flap edge includes a fold-over region for forming a sealed corner with two sidewall sections.

In a third aspect, the invention provides a multi-sided box, comprising: a plurality of sidewalls; a first flap that extends from at least two sidewalls, wherein the first flap includes a fold-over region that bridges an edge of the first flap with one of the at least two sidewalls to form a sealed corner where the first flap and at least two sidewalls meet; and a diagonal fold line that defines an edge of the fold-over region.

BRIEF DESCRIPTION OF THE DRAWINGS

These and other features of this invention will be more readily understood from the following detailed description of the various aspects of the invention taken in conjunction with the accompanying drawings in which.

DETAILED DESCRIPTION OF THE INVENTION

Figure 1:
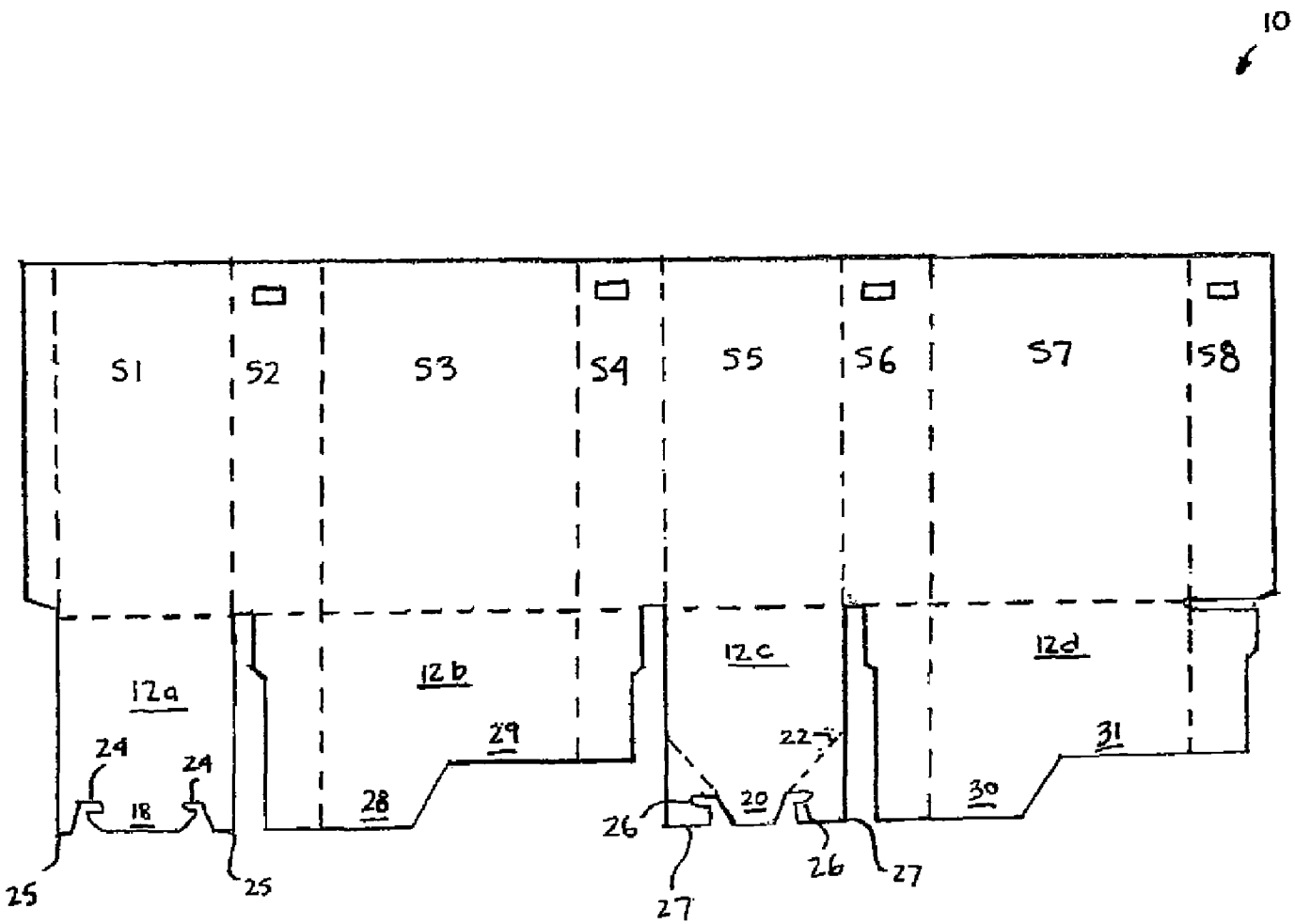
FIG. 1 depicts a detailed view of the unfolded box in accordance with the invention.

Referring now to FIG. 1, an illustrative embodiment of a box configuration is shown comprising an octagonal laminated box 10 in an unfolded form having a locking flap system. Box 10 includes eight sidewall sections indicated as S1-S8, and four bottom sections or flaps indicated as 12*a-d*. The dotted lines indicate fold lines for assembling the box. Two of the opposed flaps (also referred to herein as locking flaps), 12*a* and 12*c* have edges that include specially formed tabs 18 and 20, which allow the two flaps 12*a* and 12*c* to interconnect and secure the bottom of box 10.

Flap 12*a* comprises a generally trapezoidal shaped tab 18 with inwardly projecting grooves 24. Also included on flap 12*a* is a pair of receiving tabs 25 which are cut away from tab 18. Flap 12*c* comprises a generally trapezoidal shaped tab 20 with outwardly projecting grooves 26. Also included on flap 12*c* is a pair of locking tabs 27, which are cut toward the tab 20. Flap 12*c* includes a pair of fold lines 22 that facilitates interlocking between flaps 12*a* and 12*c*. When the flaps are brought together and corners are diagonally folded along lines 22 of flap 12*c*, the flaps interlock, forming a solid connection that cannot be separated without considerable effort or tearing.

Sections S3 and S7 also include interior flaps 12*b* and 12*d*. Each interior flap 12*b*, 12*d* includes an extended portion 28, 30 and a recessed portion 29, 31, thus forming a generally L-shaped edge. Flaps 12*b* and 12*d* overlap and interlock, as described below.

Figure 2:
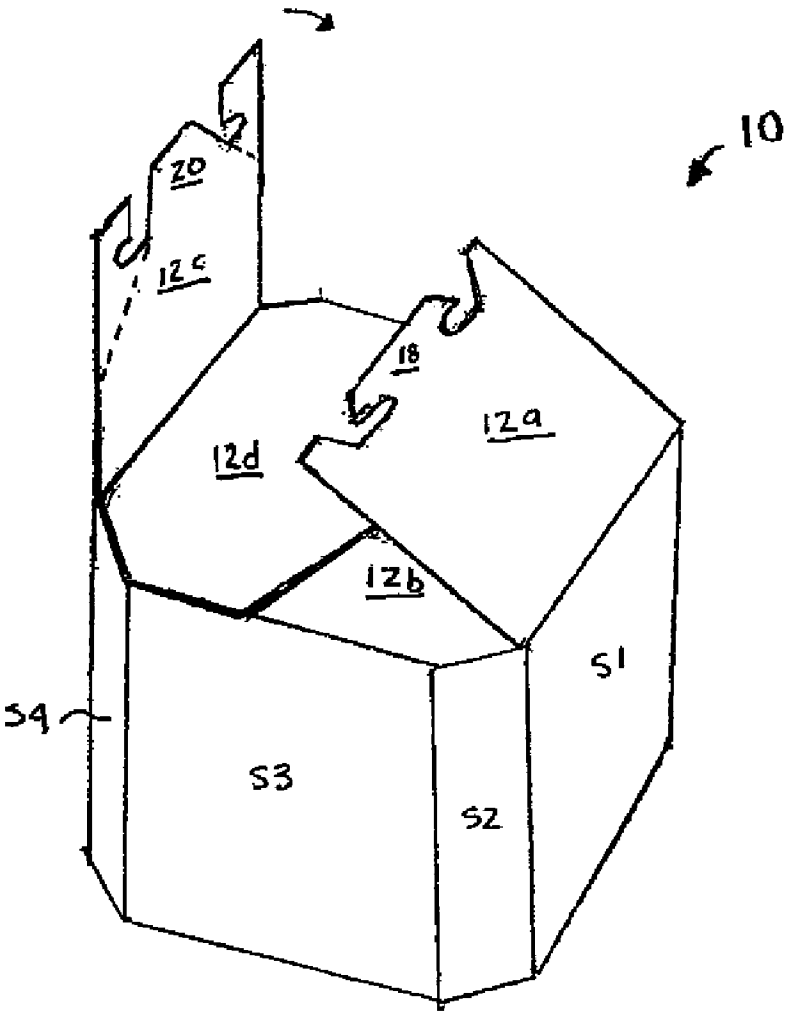
FIG. 2 depicts a bottom view of a partially folded box in accordance with the invention.

FIG. 2 depicts a bottom view of box 10 in a partially folded state. As can be seen, when the box is folded, flap 12*a* meets up with 12*c*, allowing tab 18 to interlock with tab 20. Utilizing this design, the bottom flaps 12*a-d* of box 10 can be locked together without tape, staples, etc. Moreover, the resulting self-locking design will not protrude through to the inside bottom of box 10 to create an uneven bottom surface. Instead, this design provides a virtually smooth bottom inside the box, as the locking system is totally implemented on the outside of box 10.

Figure 3:
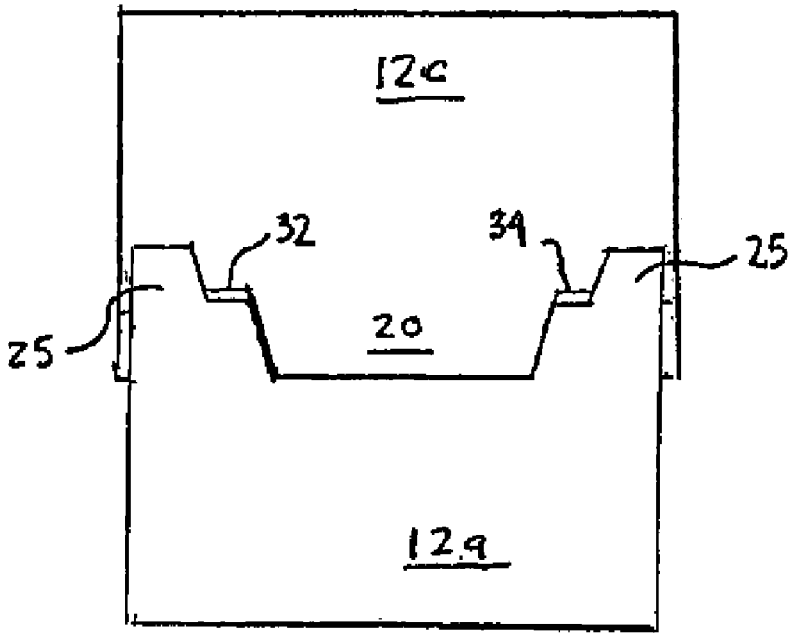
FIG. 3 depicts a view of flaps in the locked position in accordance with the invention.

To fold box 10, interior flaps 12*b* and 12*d* are first folded together such that the extended portions 28 and 30 of the flaps interlock with the recessed portions 31 and 29, respectively, to form a generally flat surface on the bottom of box 10. Next, flaps 12*a* and 12*c* are secured and locked together externally to flaps 12*b* and 12*d*. FIG. 3 depicts a view of the two flaps 12*a* and 12*c* interlocked together. As can be seen, tab 20 of flap 12*c* sits on top of tab 18 (not shown) of flap 12*a*, and receiving tabs 25 of flap 12*a* sit on top of flap 12*c*. The inwardly and outwardly projecting grooves 24, 26 of the two flaps join at locations 32 and 34.

Figure 4:
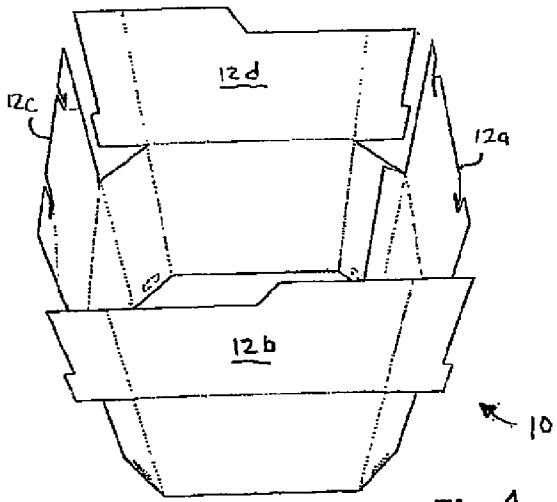
FIGS. 4-9 depict a method of closing the box of FIG. 1.
Figure 5:
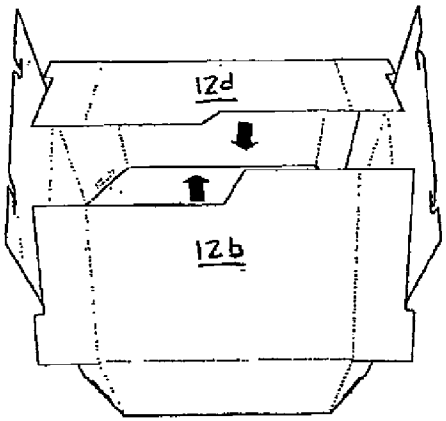
Figure 6:
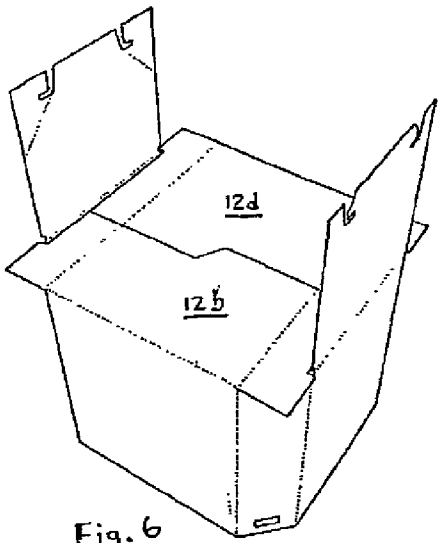
Figure 7:
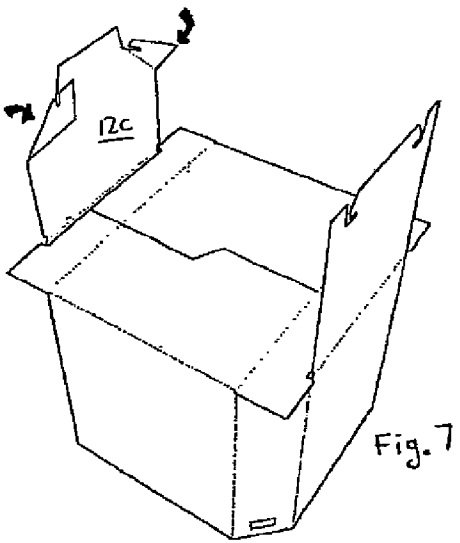
Figure 8:
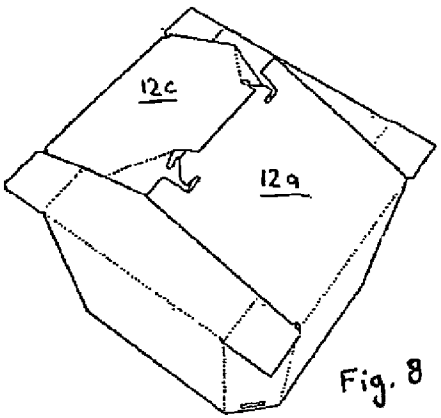
Figure 9:
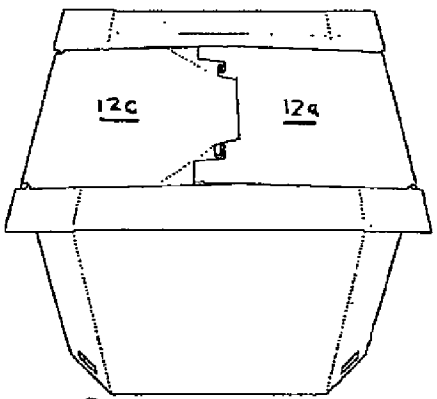

FIGS. 4-9 depict a complete method of closing the bottom flaps of box 10. In a first step, FIG. 4 depicts the bottom of box 10 with the flaps 12*a-d* extending upward. FIG. 5 depicts a second step in which flaps 12*b* and 12*d* are folded inwardly, resulting in the configuration shown in FIG. 6. FIG. 7 depicts a third step in which the corners of flap 12*c* are folded as shown by the directional arrows. FIG. 8 depicts a fourth step in which flaps 12*a* and 12*c* are interlocked, resulting in the configuration shown in FIG. 9.

Figure 10:
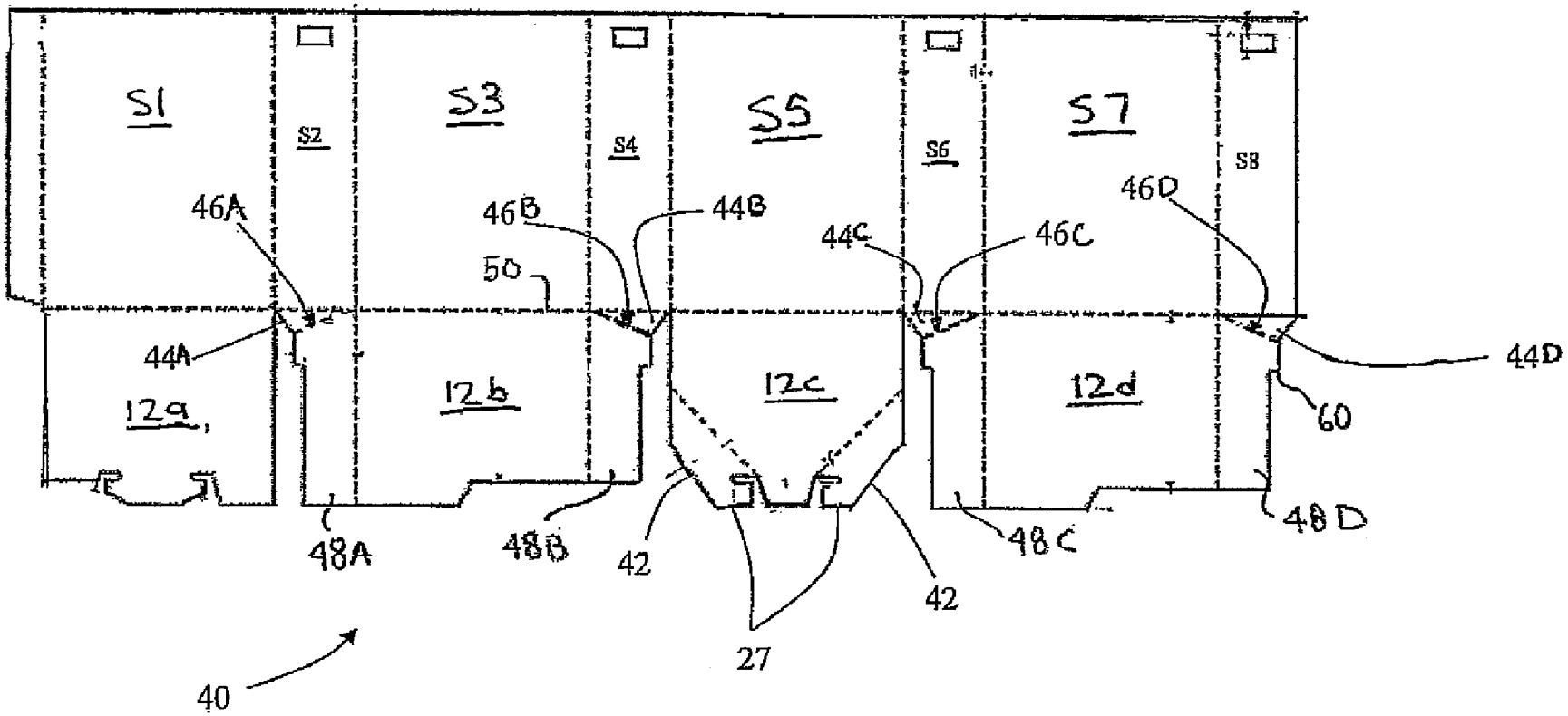
FIG. 10 depicts an alternative embodiment of an unfolded box in accordance with the present invention.

FIG. 10 depicts an alternative embodiment of a box design 40. Box design 40 is similar to that shown in FIG. 1 with the exception of two additional features. The first feature is on flap 12*c*, in which locking tabs 27 have tapered corners 42. Tapered corners 42 facilitate the locking of flap 12*c* with flap 12*a*.

The second feature of box design 40 provides what is referred to herein as a "sift proof" bottom. As can be seen, interior flaps 12*b* and 12*d* each extend from three sidewall sections (e.g., interior flap 12*b* extends from sections S2, S3 and S4). Each interior flap 12*b*, 12*d* includes unslotted "fold-over" regions 44A, 44B, 44C and 44D that bridge the smaller width sidewall sections S2, S4, S6 and S8 with flap edges 48A, 48B, 48C and 48D, respectively. Accordingly, when interior flaps 12*b* and 12*d* are folded closed, each "fold-over" region 44A, 44B, 44C and 44D allows the associated flap edge to fold back onto itself providing a sealed corner that will prevent leaking. This fold-over feature is facilitated with the use of diagonal fold lines 46A, 46B, 46C and 46D, that define an edge of each fold-over region. As can be seen, each diagonal fold line, e.g., 46D, extends diagonally to a notch 60 on the associated flap edge, e.g., 48D. By utilizing this configuration and not slotting interior flaps 12*b* and 12*d*, interior flaps 12*b* and 12*d* will provide continuously sealed corners with sections S2, S3, S4 and S6, S7, S8, respectively. This thus allows box design 40 to be filled, e.g., with resin or the like, without using a poly liner. Accordingly, this feature ensures that product in the box cannot escape through the corners.

Figure 11:
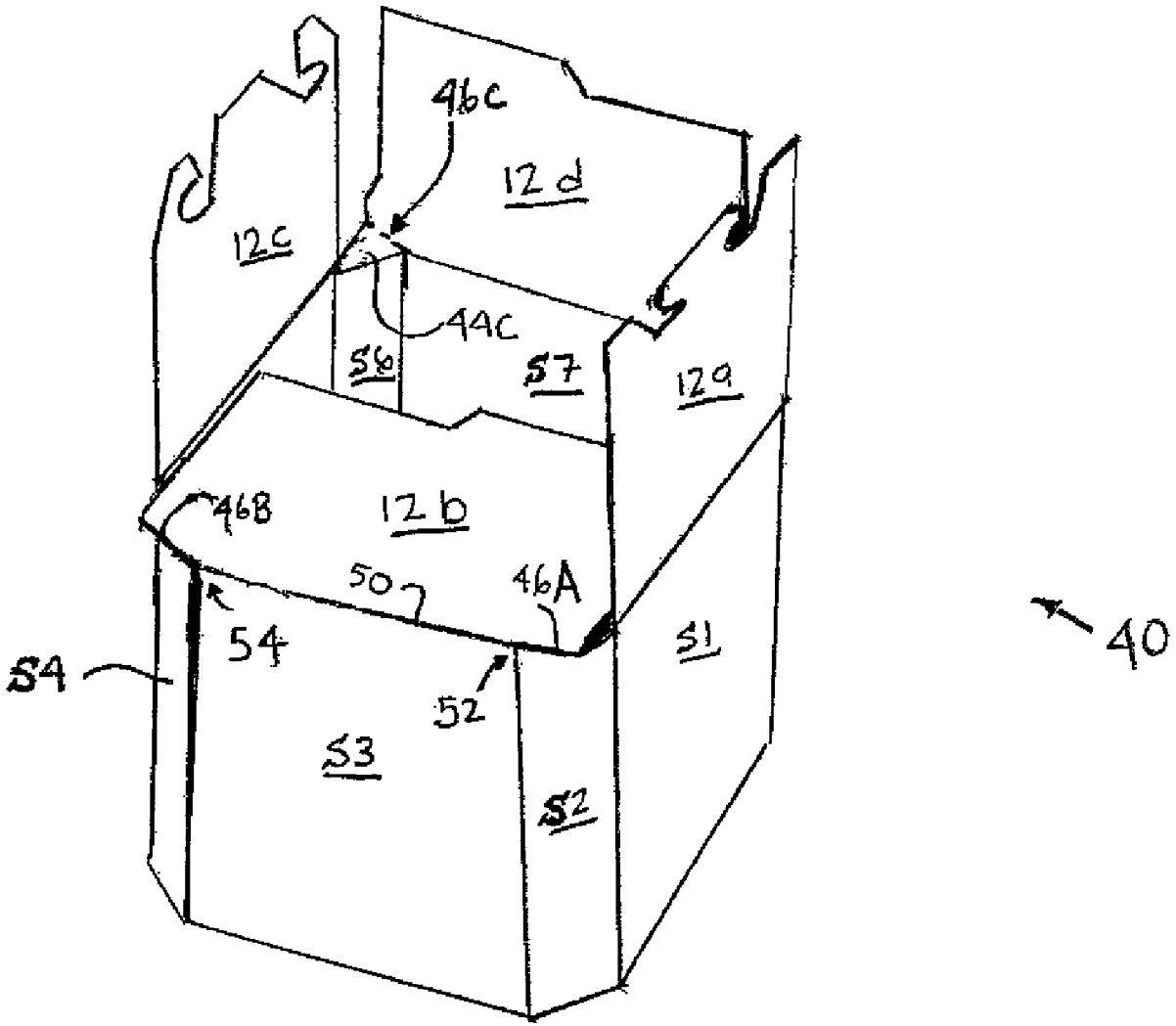
FIG. 11 depicts the embodiment of FIG. 10 partially folded.

FIG. 11 depicts an orthogonal view of box design 40 in a partially folded configuration. As can be seen, fold line 46C and fold over region 44C allow flap 12*d* (shown open) to provide a sealed corner with side sections S7 and S6. Namely, when flap 12*d* is closed, flap region 44C will collapse along fold line 46C, and provide a sealed corner with sections S6 and S7. A similar sealed corner is provided by flap 12*d* with sections S7 and S8 (hidden). The feature is also shown by flap 12*b*, which when closed along fold 50, provides sealed corners 52, 54. This thus eliminates the possibility of leakage in the corner areas 52, 54 of flap 12*b* thus providing a "sift-proof" bottom.

While the invention is described with reference to 8-sided bulk container box, it is understood that the described locking flap system could be used in other applications, e.g., in a single wall four-sided box, to lock a box top or side, etc. Moreover, for the purposes of this disclosure, the term box may refer to any container made from any material.

The foregoing description of the preferred embodiments of the invention has been presented for purposes of illustration and description. They are not intended to be exhaustive or to limit the invention to the precise form disclosed, and obviously many modifications and variations are possible in light of the above teachings. Such modifications and variations that are apparent to a person skilled in the art are intended to be included within the scope of this invention as defined by the accompanying claims.

The invention claimed is:

1. An octagonal shaped foldable box having a flap locking system, comprising:

eight sidewall sections;

a first locking flap and a second locking flap extending from two of the eight sidewall sections and opposed from each other, each of the first locking flap and the second locking flap having a generally trapezoidal shaped tab cut therein for locking the first locking flap with the second locking flap; and a pair of opposing interior flaps, wherein each opposing interior flap extends from three of the eight sidewall sections, and wherein each opposing interior flap includes a first and a second flap edge, and each flap edge includes a fold-over region for forming a sealed corner with two of the eight sidewall sections.

2. The octagonal shaped foldable box of claim 1, wherein each fold-over region includes a fold line.

3. The octagonal shaped foldable box of claim 1, wherein each fold-over region bridges a sidewall section with a flap edge.

4. The octagonal shaped foldable box of claim 1, wherein each flap edge includes a notch.

5. The octagonal shaped foldable box of claim 1, wherein each opposing interior flap is L-shaped.

6. The octagonal shaped foldable box of claim 1, wherein the first locking flap includes tapered corners.

7. The octagonal shaped foldable box of claim 6, wherein the first locking flap includes diagonal fold lines that project outwardly from the generally trapezoidal shaped tab.

8. A foldable box having sealed corners, comprising:

eight sidewall sections;

a pair of opposing exterior locking flaps extending from a first pair of the eight sidewall sections, each opposing exterior locking flap having a locking mechanism cut therein for locking the pair of opposing exterior locking flaps together wherein one of the pair of opposing exterior locking flaps includes diagonal fold lines that project outwardly from a generally trapezoidal shaped tab that forms the locking mechanism; and a pair of opposing interior flaps, wherein each opposing interior flap extends from three of the eight sidewall sections, and wherein each opposing interior flap includes a first and a second flap edge, and each flap edge includes a fold-over region for forming a sealed corner with two of the eight sidewall sections.

9. The foldable box of claim 8, wherein each fold-over region includes a fold line.

10. The foldable box of claim 8, wherein each fold-over region bridges a sidewall section with a flap edge.

11. The foldable box of claim 8, wherein each flap edge includes a notch.

12. The foldable box of claim 8, wherein each opposing interior flap is L-shaped.

13. The foldable box of claim 8, wherein one of the pair of opposing exterior locking flaps includes tapered corners.

14. A multi-sided box, comprising:

a plurality of sidewalls;

a first flap that extends from at least two of the plurality of sidewalls, wherein the first flap includes a fold-over region that bridges an edge of the first flap with one of the at least two of the plurality of sidewalls to form a sealed corner where the first flap and the at least two of the plurality of sidewalls meet;

a diagonal fold line that defines an edge of the fold-over region; and a pair of opposing locking flaps extending from the plurality of sidewall sections, each opposing exterior locking flap having a generally trapezoidal shaped tab cut therein for locking the pair of opposing exterior locking flaps together.

15. The multi-sided box of claim 14, wherein the first flap extends from a set of three adjacent sidewalls of the plurality of sidewalls and includes two fold-over regions.

16. The multi-sided box of claim 15, further comprising a second flap that extends from a second set of three adjacent sidewalls of the plurality of sidewalls and includes two fold-over regions.

17. The multi-sided box of claim 16, further comprising a third and fourth flap that include locking tabs.

18. The multi-sided box of claim 17, wherein the first and second flaps reside on an interior of the multisided box and the third and fourth flap reside on an exterior of the multi-sided box.

19. The multi-sided box of claim 18, wherein the third flap includes tapered corners.

* * * * *